United States Patent [19]

Brackett

[11] Patent Number: 4,852,813

[45] Date of Patent: Aug. 1, 1989

[54] METHOD FOR TREATING GARBAGE DISPOSAL UNITS

[76] Inventor: Douglas C. Brackett, 196 Pine St., Portland, Me. 04102

[21] Appl. No.: 208,235

[22] Filed: Jun. 17, 1988

[51] Int. Cl.[4] ..... B02C 19/00; B02C 23/00

[52] U.S. Cl. ..... 241/30; 241/46 A; 241/46.17

[58] Field of Search ..... 241/46 A, 46 B, 46 R, 241/46.11, 46.17, 15, 16, 30, DIG. 30; 15/95

[56] References Cited

U.S. PATENT DOCUMENTS 4,480,795 11/1984 Pellegrino ..... 241/46 B X

*Primary Examiner*—Timothy V. Eley

*Attorney, Agent, or Firm*—Ralph W. Selitto, Jr.

[57] ABSTRACT

A garbage disposal unit is treated by a device which, in response to the activation of the garbage disposal unit, is propelled against a wall of an interior chamber of the unit. Due to its natural elasticity, the device ricochets off of the wall, thereby randomly striking and treating a plurality of areas on the wall. Ingredients, such as detergents, degreasers, scouring agents, disinfectants, foaming agents, sterilizers, etc., can be added to the device prior to or during operation in order to facilitate such treatment.

18 Claims, 2 Drawing Sheets

METHOD FOR TREATING GARBAGE DISPOSAL UNITS

FIELD OF THE INVENTION

The present invention relates to a method and device for treating garbage disposal units, and, more particularly, to such a method and device for cleaning, degreasing, scouring, disinfecting and/or deodorizing garbage disposal units.

BACKGROUND OF THE INVENTION

The garbage disposal unit is a common kitchen appliance, yet a convenient means for cleaning it does not exist. Currently, the only known method is to disassemble the unit and scrub the interior. A conventional unit includes a cylindrical disposal chamber and grinder assembly, both of which are not readily accessible in most installations. As a result, the disassembling and scrubbing operations are relatively complicated, time consuming and painstaking. In such circumstances, cleanings are few and far apart.

Between cleanings, sanitary problems arise. The grinder splatters food scraps and refuse on the chamber walls during its normal operation. Fluids released by the food corrode the disposal equipment. As the food debris accumulates and decays, germs and bacteria grow causing a health hazard as well as an unpleasant odor.

SUMMARY OF THE PRESENT INVENTION

The problems and disadvantages associated with the conventional technique for cleaning garbage disposal units are overcome by the present invention, which involves the use of a new and improved device comprising a body which is deformable upon impact with a wall of an interior chamber of the garbage disposal unit and which is erodable in response to the rotation of the grinder assembly of the garbage disposal unit. The body of the device is made from a material having an elastic memory selected such that said device automatically returns to its original shape after contacting the wall of the garbage disposal unit, whereby the device ricochets off of the wall so as to randomly strike and therefore treat a plurality of areas on the wall. The device has a porosity selected such that it can absorb fluids, whereby ingredients such as water, degreasers, detergents, scouring agents, disinfectants, foaming agents, deodorizers and sterilizers can be added to the device in order to enhance the treatment of the garbage disposal unit.

BRIEF DESCRIPTION OF THE DRAWINGS

For a better understanding of the present invention, reference is made to the following detailed description of several exemplary embodiments considered in conjunction with the accompanying drawings, in which.

DESCRIPTION OF THE EXEMPLARY EMBODIMENTS

Figure 1:
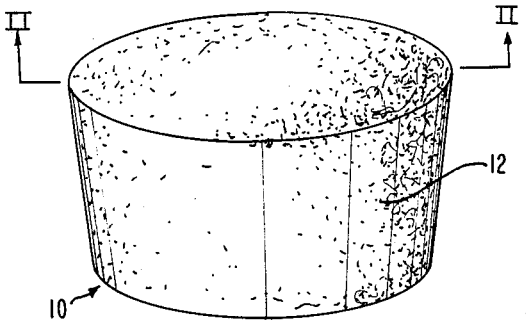
FIG. 1 is a perspective view of a device adapted to automatically treat a garbage disposal unit, the device being constructed in accordance with one exemplary embodiment of the present invention.
Figure 2:
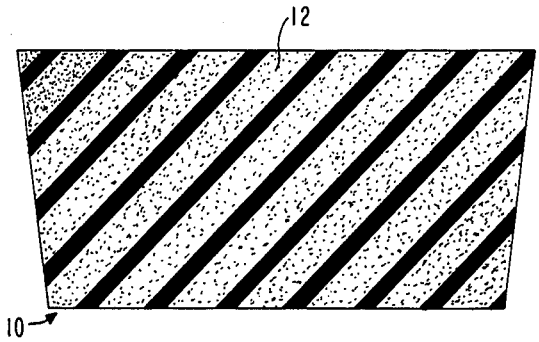
FIG. 2 is a cross-sectional view, taken along section line II—II in FIG. 1 and looking in the direction of the arrows, of the device illustrated in FIG. 1.

Referring to FIGS. 1 and 2, there is shown a device 10 having a monolithic body 12, which is made of an elastic material, such as a sponge-like material or a light synthetic foam. The device 10 preferably has the following characteristics: (i) an elasticity selected so as to induce bouncing for purposes which will be described hereinafter; and (ii) a porosity selected so as to promote absorption for purposes which will be described hereinafter. The device 10 should also be deformable and erodable for reasons which will be described in greater detail below. The density, weight and shape of the device 10 can be utilized to control its operating characteristics in a manner which will become more evident when the device 10 is described in connection with the following description of its operation.

Figure 3:
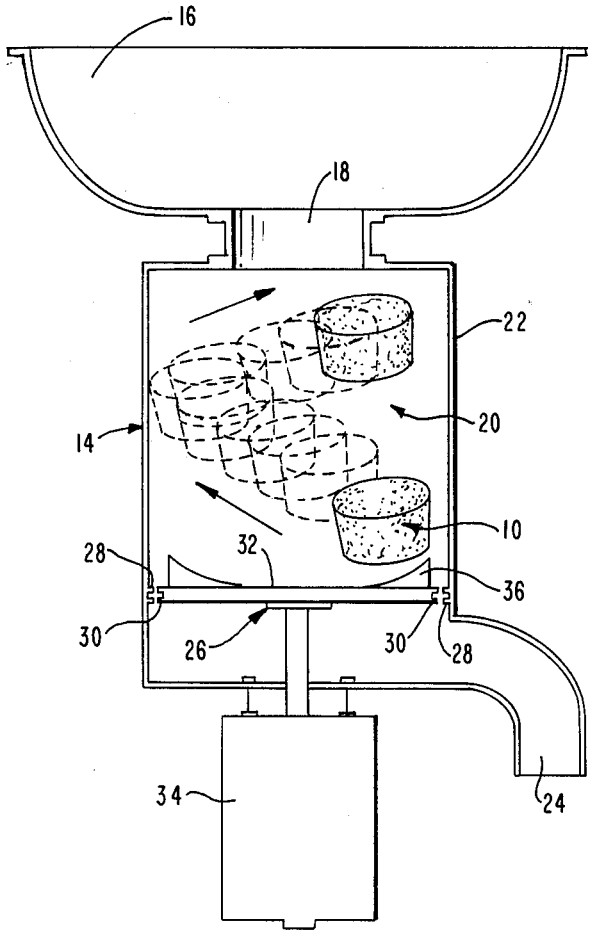
FIG. 3 is a schematic illustration showing the device of FIGS. 1 and 2 in the process of treating a conventional garbage disposal unit.

With reference to FIG. 3, a conventional garbage disposal unit 14 is located below a sink 16, which includes a faucet (not shown). The sink 16 has a drain 18 which serves as an inlet to the garbage disposal unit 14. More particularly, the drain 18 communicates directly with an interior chamber 20 of the garbage disposal unit 14, the chamber 20 being defined by a cylindrical wall 22. A drain pipe 24 functions as an outlet for the garbage disposal unit 14. The interior chamber 20 houses a grinder assembly 26 which includes a first set of teeth 28 fixedly attached to the wall 22 and a second set of teeth 30 attached to a grinder wheel 32. The grinder wheel 32, which is rotated by a motor 34, also includes a plurality of paddles 36 which propel food debris against the wall 22 in response to the rotation of the grinder wheel 32. The rotation of the grinder wheel 32 also causes food scraps and other debris contained in the interior chamber 20 to be "chewed" by the teeth 28, 30. A strainer cover (not shown) is positioned over the drain 18 to prevent the food scraps and other debris from flying out of the interior chamber 20 during the operation of the garbage disposal unit 14. If the garbage disposal unit 14 complies with recent OSHA regulations, the strainer cover (not shown) must be properly positioned before the unit can be activated.

Referring still to FIG. 3, in order to treat the garbage disposal unit 14 in accordance with the present invention, the device 10 is inserted into the interior chamber 20 through the drain 18. Either before or after the insertion of the device 10, one or more ingredients can be added to the device 10 by the user. Possible ingredients include, for example, degreasers, detergents, scouring agents, disinfectants, foaming agents, sterilizers and deodorizers. It should be understood that such ingredients can be dispensed as a liquid, a powder or in any other suitable form.

The garbage disposal unit 14 is activated (by turning on the motor 34), either before or after the insertion of the device 10. If the strainer cover (not shown) must be properly positioned before activating the garbage disposal unit 14, then the device 10 would obviously have to be inserted into the interior chamber 20 before the garbage disposal unit 14 is activated. When the device 10 contacts one of the paddles 36 of the rotating grinder wheel 32, the device 10 is propelled against a random area on the wall 22. Upon impact with the wall 22, the device 10 collapses or deforms, thereby inducing a pumping and frothing action as ingredients within the body 12 travel to the surface of the device 10. The ingredients released from the body 12 cooperate with the impact force resulting from the device 10 being propelled against the wall 22 to clean and/or otherwise treat the wall 22. The impact force can be increased by increasing the weight and hence inertia of the device 10. Because the body 12 is porous, the weight of the device can be increased through the absorption of water by allowing water from the faucet (not shown) of the sink 16 to run during at least a portion of the operating cycle or by pre-soaking the device 10.

The inertia and trajectory of the device 10 result in relative movement between the device 10 and the wall 22 during their impact with each other. Such relative movement together with the deformation of the device 10 cooperates to produce a "wiping" effect. This wiping effect, which promotes the cleaning action of the device 10, can be enhanced, for instance, by increasing the weight of the device 10.

As the elastic memory of the device 10 causes it to return to its original shape, the device 10 bounces off of the wall 22. After having "ricochetted" off of various different areas on the wall 22, the device 10 falls into the grinder assembly 26, where it is either partially eroded by the "chewing" action of the teeth 28, 30 or is contacted by one of the paddles 36 and thereby propelled once again against the wall 22. Eventually, the device 10 will erode to such an extent that it will pass between the teeth 28, 30 and exit the garbage disposal unit 14 through the drain pipe 24. If the drain pipe 24 is connected to a septic tank (not shown) the device 10 should preferably be made of a biodegradable material in order to prevent a build up in the septic tank.

The size and shape of the device 10 influence its operating life. For instance, if the device 10 is provided with sharp edges, it will more readily fit between the teeth 28, 30 of the grinder assembly 26 and will therefore be apt to erode at a relatively fast rate. The density of the device 10 also has an effect on its operating life (i.e., a lower density material will erode faster than a material having a higher density).

The nature of the treatment is determined by the ingredients added to the device 10. Thus, a combination cleaning and sterilizing operation can be performed by adding a detergent and a sterilizer to the device 10. If a combination disinfecting and deodorizing operation is to be performed, then a disinfectant and a deodorizer would be added to the device 10. It should, of course, be understood that the ingredients can be added to the device 10 in many different combinations.

Rather than having the user add the ingredients to the device 10, the ingredients can be added during manufacture in accordance with other exemplary embodiments of the present invention, such as those illustrated in FIGS. 4–8. Each of these embodiments will be described individually below. Unless otherwise indicated, the embodiments illustrated in FIGS. 4–8 operate in the same manner as the embodiment of FIGS. 1 and 2.

Figure 4:
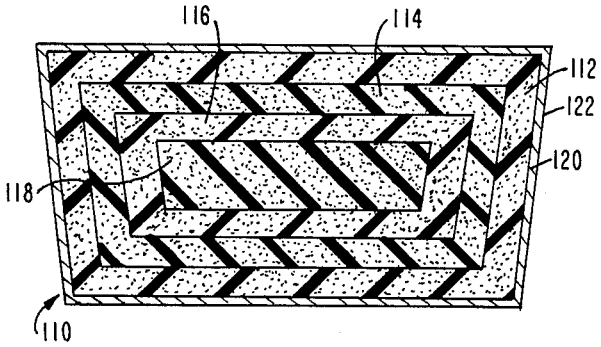
FIG. 4 is a cross-sectional view, similar to FIG. 2, showing a second exemplary embodiment of a device constructed in accordance with the present invention.

Referring now to FIG. 4, a device 110 includes concentrically-arranged layers 112, 114, 116, 118, which are bonded together to form a laminated body 120. Ingredients can be added to one or more of the layers 112–118 during the manufacture of the device 110. Depending upon the ingredients contained within each of the layers 112–118, the sequential release of the ingredients can be controlled by the natural erosion of the device 110. A protective skin 122 prevents the inadvertent or premature release of the ingredients. If the ingredients are intended to be added by the user, rather than during manufacture, then the protective skin 122 could be eliminated from the device 110.

Figure 5:
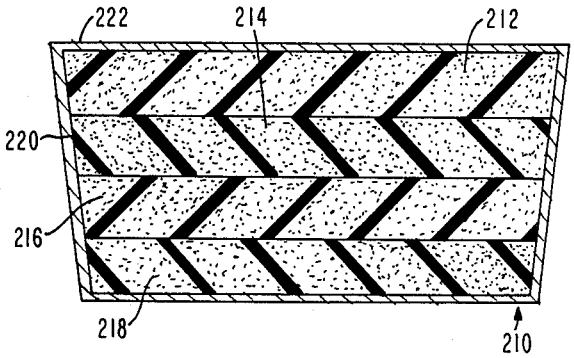
FIG. 5 is a cross-sectional view, similar to FIG. 2, of a third exemplary embodiment of a device constructed in accordance with the present invention.

With reference now to FIG. 5, a device 210 includes consecutively-arranged layers 212, 214, 216, 218, which are bonded together to form a laminated body 220. Ingredients can be added to one or more of the layers 212–218 during the manufacture of the device 210. Depending upon the ingredients contained within each of the layers 212–218, the sequential release of the ingredients can be controlled by the natural erosion of the device 210. A protective skin 222 prevents the inadvertent or premature release of the ingredients. If the ingredients are to be added by the user rather than during manufacture, then the protective skin 222 could be eliminated from the device 210.

Figure 6:
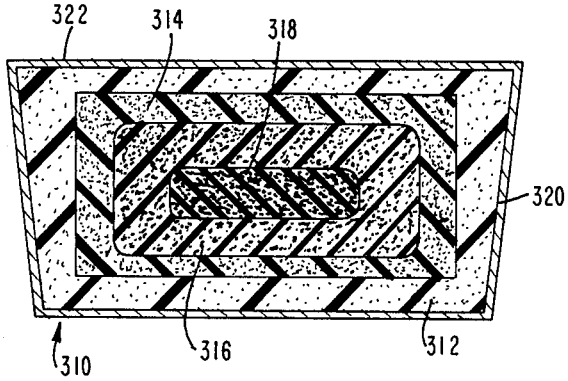
FIG. 6 is a cross-sectional view, similar to FIG. 2, of a fourth exemplary embodiment of a device constructed in accordance with the present invention.

Referring now to FIG. 6, a device 310 includes concentrically-arranged layers 312, 314, 216, 318 which are bonded together to form a laminated body 320. Each of the layers 312–318 has a different density. Ingredients may be added to one or more of the layers 312-318 during the manufacture of the device 310. Depending upon the ingredients contained within each of the layers 312–318, the sequential release of the ingredients can be controlled by the natural erosion of the device 310. Moreover, the treatment time o a particular ingredient can be regulated depending upon the density of the material in which it is contained. For instance, a higher density material takes more time to erode which results in a longer treatment time; therefore, it is desirable to add a cleaning agent, such as a detergent, to one or more of the layers 312–318 having a relatively high density to thereby prolong the cleaning operation performed by such an agent. A protective skin 322 protects the inadvertent or premature release of the ingredients. If the ingredients are to be added by the user rather than during manufacture, then the protective skin 322 could be eliminated from the device 310.

Figure 7:
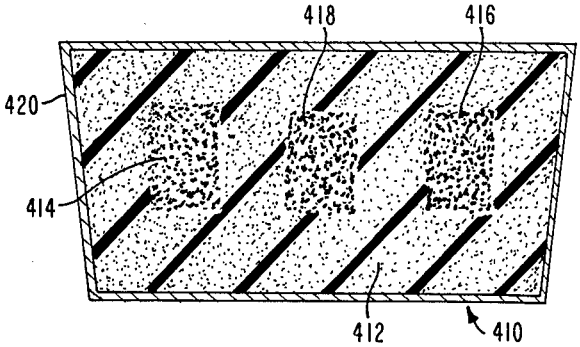
FIG. 7 is a cross-sectional view, similar to FIG. 2, of a fifth exemplary embodiment of a device constructed in accordance with the present invention.

With reference now to FIG. 7, a device 410 includes a monolithic body 412 which has an absorbency selected such that the device 410 can be impregnated with various different ingredients at selectively located zones 414, 416, 418. Depending upon the ingredients contained within each of the zones 414–418, the sequential release of the ingredients can be controlled by the natural erosion of the device 410. A protective skin 420 prevents the inadvertent or premature release of the ingredients. If the ingredients are to be added by the user rather than during manufacture, then the protective skin 420 could be eliminated from the device 410.

Figure 8:
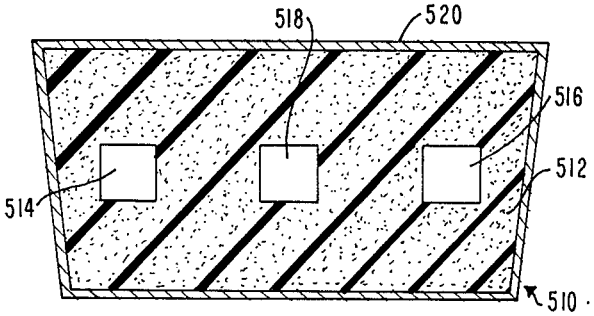
FIG. 8 is a cross-sectional view, similar to FIG. 2, of a sixth exemplary embodiment of a device constructed in accordance with the present invention.

Referring finally to FIG. 8, a device 510 includes a monolithic body 512 having caches 514, 516, 518. Each of the caches 514–518 is adapted to contain one or more ingredients. Depending upon the ingredients contained within each of the caches 414–418, the sequential release of the ingredients can be controlled by the natural erosion of the device 510. Moreover, the sequential release of the ingredients can be regulated by varying the location of the caches 514–518. A protective skin 520 prevents the inadvertent or premature release of the ingredients. If the ingredients are to be added by the user rather than during manufacture, then the protective skin 520 could be eliminated from the device 510.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

I claim:

1. A method for automatically treating a garbage disposal unit, which includes an interior chamber defined by a surrounding wall and a rotatable grinder assembly located within the chamber, using a device, which includes a body which is deformable upon impact with the wall of the garbage disposal unit and which is erodable in response to the rotation of the grinder assembly of the garbage disposal unit, the body being made from a material having an elastic memory selected such that the device automatically returns to its original shape after contacting the wall of the garbage disposal unit and having a porosity selected such that the device absorbs fluids, said method comprising the steps of:

(a) inserting the device into the interior chamber of the garbage disposal unit;

(b) activating the garbage disposal unit; and (c) rotating the grinder assembly such that the grinder assembly contacts the device and propels the device against the wall of the chamber with a force sufficient to cause the device to ricochet off of the wall, thereby randomly striking and treating a plurality of areas on the wall of the chamber, the rotation of the grinder assembly continuing without substantial interruption until the grinder assembly has eroded the device to such an extent that the device can no longer be propelled by the grinder assembly and is small enough to exit the garbage disposal unit.

2. A method according to claim 1, wherein step (a) is performed before step (b).

3. A method according to claim 1, wherein step (a) is performed after step (b).

4. A method according to claim 1, further comprising the step of adding to the device an ingredient for treating the garbage disposal unit.

5. A method according to claim 4, wherein the ingredient is added before the performance of step (a).

6. A method according to claim 4, wherein the ingredient is added after the performance of step (a).

7. A method according to claim 6, wherein the ingredient is added during the performance of step (c).

8. A method according to claim 4, wherein the ingredient is selected from a group consisting of a degreaser, a detergent, a scouring agent, a disinfectant, a foaming agent, a deodorizer and a sterilizer.

9. A method according to claim 1, further comprising the step of adding to the device a plurality of ingredients for treating the garbage disposal unit, the ingredients being selectively located within the device so as to regulate the sequential release of the ingredients in response to the natural erosion of the device by the grinder assembly of the garbage disposal unit.

10. A method according to claim 9, wherein the ingredients are contained in different layers of the device.

11. A method according to claim 10, wherein at least one of the layers has a density selected so as to regulate the release rate of the ingredient contained therein.

12. A method according to claim 9, wherein the ingredients are impregnated into the device.

13. A method according to claim 9, wherein the ingredients are contained in caches arranged within the device.

14. A method according to claim 1, further comprising the step of adding a fluid to the device in order to increase its weight and thereby vary its operating characteristics.

15. A method according to claim 1, wherein the garbage disposal unit includes an inlet to the interior chamber and an outlet from the interior chamber and wherein the device has a size and shape selected such that the device is small enough to be inserted into the interior chamber through the inlet during the performance of step (a) but is large enough so as not to pass through the grinder assembly and out of the outlet until the grinder assembly has been rotated for a predetermined length of time.

16. A method according to claim 1, wherein the grinder assembly chews the device so as to cause the device to be partially eroded, thereby reducing the size of the device.

17. A method according to claim 16, wherein the device is contacted and propelled by paddles provided on the grinder assembly.

18. A method according to claim 17, wherein the device is chewed by teeth provided on the grinder assembly.

* * * * *